US009088059B1

(12) United States Patent
Church et al.

(10) Patent No.: US 9,088,059 B1
(45) Date of Patent: Jul. 21, 2015

(54) EQUAL PHASE AND EQUAL PHASED SLOPE METAMATERIAL TRANSMISSION LINES

(71) Applicants: Justin A. Church, San Diego, CA (US); John Meloling, San Diego, CA (US); John D. Rockway, San Diego, CA (US)

(72) Inventors: Justin A. Church, San Diego, CA (US); John Meloling, San Diego, CA (US); John D. Rockway, San Diego, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 312 days.

(21) Appl. No.: 13/903,522

(22) Filed: May 28, 2013

(51) Int. Cl.

| | |
|---|---|
| ***H01P 3/08*** | (2006.01) |
| ***H01P 1/18*** | (2006.01) |
| ***H01P 11/00*** | (2006.01) |
| *H01Q 3/26* | (2006.01) |

(52) U.S. Cl.
CPC ..... *H01P 3/08* (2013.01); *H01P 11/003* (2013.01)

(58) Field of Classification Search
CPC ..... H01P 5/12; H01P 1/18; G02B 1/007; H01Q 13/206; H01Q 25/00; H01Q 3/26; H01Q 3/36
USPC ..... 333/112, 136, 204, 236, 246; 343/745, 343/749, 700 MS
See application file for complete search history.

(56) References Cited

U.S. PATENT DOCUMENTS

| | | | | |
|---|---|---|---|---|
| 7,508,283 | B2 * | 3/2009 | Itoh et al. | 333/118 |
| 7,855,696 | B2 * | 12/2010 | Gummalla et al. | 343/876 |
| 8,264,405 | B2 * | 9/2012 | Pozgay | 342/363 |
| 8,294,533 | B2 * | 10/2012 | Dupuy et al. | 333/136 |
| 8,346,189 | B2 * | 1/2013 | Dupuy et al. | 455/114.1 |
| 8,462,063 | B2 * | 6/2013 | Gummalla et al. | 343/745 |
| 8,680,945 | B1 * | 3/2014 | Wang | 333/139 |
| 8,786,383 | B2 * | 7/2014 | Dupuy | 333/101 |
| 2010/0171563 | A1 | 7/2010 | Dupuy et al. | |
| 2011/0109402 | A1 | 5/2011 | Dupuy et al. | |
| 2013/0321093 | A1 * | 12/2013 | Ueda et al. | 333/17.3 |

OTHER PUBLICATIONS

Kang, Minwook et al., "Miniaturized MIM CRLH Transmission Line Structure and Application to Backfire-to-Endfire Leaky Wave Antenna", IEEE International and Propagation Society, vol. 1, 2004, pp. 827-830.
Li, Y. et al., "Design of a 1*20 Series Feed Network with Composite Right/Left-Handed Transmission Line", Progress in Electromagnetics Research, vol. 89, 311-324, 2009.
Antoniades, M.A., "Compact Linear Metamaterial Phase Shifters for Broadband Applications", Ph.D. Dissertation, University of Toronto, ON, 2009 (All).
Church, Justib A., "Equal Phase Siope Metamaterial Transmission Lines", IEEE 978-1-4673-0462-7/12, IEEE APS/URSI International Symposium on Antennas and Propagation, Jul. 2012.

* cited by examiner

*Primary Examiner* — Dean Takaoka
*Assistant Examiner* — Alan Wong
(74) *Attorney, Agent, or Firm* — SSC Pacific Patent Office; Arthur K. Samora; Kyle Eppele

(57) ABSTRACT

Methods for establishing metamaterial transmission line (MTM TL's) for a phased array antenna can include the initial step of defining a defining a Composite Right/Left Hand (CRLH) CRLH unit cell architecture. A family of unit cells using CRLH TL microstrip architecture can be constructed so that each of the CRLH unit cells have the same physical length, but different cell phases and cell phase slopes. To do this, the stub length of each CRLH unit cell can be varied. Once the family of CRLH unit cells is constructed, different numbers of different CRLH unit cells from the family can be combined with different numbers of conventional right hand TL's, which results in TL's for a phased array antenna that each have the same overall phase and overall phase slope not only at the design frequency $f_0$, but over the entire design frequency band for the antenna.

9 Claims, 6 Drawing Sheets

Left Handed (LH)

Right Handed (RH)

ω

Composite (CRLH)

EQUAL PHASE AND EQUAL PHASED SLOPE METAMATERIAL TRANSMISSION LINES

FEDERALLY-SPONSORED RESEARCH AND DEVELOPMENT

This invention (Navy Case No. 101813) is assigned to the United States Government and is available for licensing for commercial purposes. Licensing and technical inquires may be directed to the Office of Research and Technical Applications, Space and Naval Warfare Systems Center, Pacific, Code 72120, San Diego, Calif. 92152; voice (619) 553-5118; email ssc pac T2@navy.mil.

FIELD OF THE INVENTION

The present invention pertains generally to antennas. More specifically, the present invention pertains to metamaterial transmission lines (MTM TL's) for phased array antennas. The invention is particularly, but not exclusively useful as a device and a method of designing a family of different length MTM TL's for phased array antennas, so that each MTM TL in the family achieves the desired phase at the design frequency, with equal phase slope over the entire design bandwidth.

BACKGROUND OF THE INVENTION

Phased array antennas are well known in the prior art. For phased array antennas, transmission lines in the feed networks of phased antenna arrays can be used to divide equally the power in, and to phase appropriately each of the antenna elements in the phased array.

One challenge in phased array antenna design can be to minimize the respective physical footprint occupied by the supporting RF circuits (which includes the transmissions lines). The culprit here can often be the phase delay lines. Phase delay lines, such as conventional microstrip transmission lines (TL's), must be designed to be a certain physical length in order to achieve a given desired phase shift at a given design frequency. This phase dependency on length can result in lines that must be "meandered" in order to maintain a small footprint, as in passive phased arrays. In addition, this length dependency on phase can result in increasing phase slopes, as the lines increase in physical length. This creates a variety of different problems, including an expanding physical footprint. Another problem can be a limitation in phase bandwidth that arises from TL's of different physical lengths having different phase slopes.

Another design consideration for phased array antennas is the phase slope, i.e., the change in phase over the frequency band of interest. For conventional TL's, the slope of the phase response is a function of the physical length of the transmission line. As a result, as length of the conventional TL's increase, the phase slope can also increase. When conventional TL's of different lengths exhibit this phase slope behavior, this can lead to a variety of performance issues for the antenna. More specifically, at the design frequency of the antenna, all of the TL's have the same phase while outside of the design frequency each of the TL's begin to exhibit increasingly different phase values. The increasing different phase values (due to the drift in phase slope) can result in a radiation pattern for the array that can begin to diverge and scatter as a function frequency, since each antenna element in the array no longer maintains a uniform phase difference. This phenomena is often referred to as "beam squint". Beam squint is typically an undesirable effect for phased array antennas, and should be avoided.

To avoid beam squint, hybrid metamaterial transmission Lines (MTM-TL's) can be used. MTM TL's can combine the negative phase (or phase delay) of conventional, right-handed (RH) transmission lines, with the positive phase (phase advance) exhibited by left-handed (LH) transmission lines. MTM-TL's can be designed from combinations of right-handed TL's and Composite Right/Left Hand (CRLH) TL's. The single CRLH unit cells, in which the CRLH TL's are composed of, are of the same physical length but have different phase and phase slopes associated with each. These Composite Right/Left Hand (CRLH) transmission lines can achieve a negative phase velocity in the left-hand frequency band, and a positive phase velocity in the right-hand frequency band. Thus arbitrary phase-shifts can be achieved, zero and non-zero, both positive and negative phase across the length of the transmission line, independent of its physical length.

The prior art using conventional transmission lines and MTM TL's does not disclose constructing a family of MTM TL's that can achieve both equal phase and phase slope response. The significance of these engineered MTM-TL's is their improved performance over a wider bandwidth, and their ability to occupy smaller footprints, because they can be routed more effectively within tightly fitting phase shifting networks for use in various RF and phased array antenna applications.

In view of the above, it is an objective of the present invention to provide a plurality of MTM-TL's that minimizes beam squint for a phased array antenna. Another object of the present invention is to provide MTM-TL's for a phased array antenna that each have a substantially equal phase slope response over a broadband frequency range. Still another object of the present invention is to provide MTM-TL's for a phased array antenna that have a smaller physical footprint relative to a TL's for the phased array antenna of same electrical size. Yet another object of the present invention is to provide MTM-TL's for a phased array antenna which have greater power out when compared to conventional TL's having the same physical size. Another object of the present invention is to provide MTM-TL's for a phased array antenna that are easy to manufacture in a cost effective manner.

SUMMARY OF THE INVENTION

A plurality of metamaterial transmission line (MTM TL's) for a phased array antenna and methods for establishing the plurality of MTM TL's in accordance with several embodiments of the present invention can include the initial step of defining a Composite Right/Left Hand (CRLH) TL architecture for a CRLH unit cell. For antennas having a design frequency $f_0$ above 1 GHz, architecture can comprise microstrip architecture, or a metal ground layer/dielectric/metal inductor stub type of arrangement.

The methods can further include the step of constructing a family of unit cells using the CRLH TL architecture, so that each of the CRLH unit cells have the same physical length, but different cell phases and different cell phase slopes. To do this, a first unit cell having a phase of zero degrees can be constructed. The first unit cell can have a defined cell geometry that includes a first cell length and a first stub length. Next a plurality of other unit cells can be constructed with the same cell length, but different inductor stub lengths. This can result in a plurality of CRLH unit cells with different phases.

Once the aforementioned family of CRLH unit cells is constructed, antenna and method can further include the step of combining different numbers of different CRLH unit cells from the family of CRLH unit cells, with different numbers of conventional right hand TL's. The result is a plurality of transmission lines (TL's) for a phased array antenna, each of which have the same overall phase and an overall phase slope not only at the design frequency $f_0$, but over the entire design frequency band for the antenna.

BRIEF DESCRIPTION OF THE DRAWINGS

The novel features of the present invention will be best understood from the accompanying drawings, taken in conjunction with their accompanying descriptions, in which similarly-referenced characters refer to similarly-referenced parts, and in which.

DETAILED DESCRIPTION OF THE EMBODIMENTS

In brief overview of the prior art, one challenge in antenna phased array antenna design is to minimize the footprint occupied by the supporting RF circuits. Transmission lines in the feed networks of phased antenna arrays function to divide input power equally among the array elements, and they are used to appropriately phase each of the antenna elements in the array. The transmission lines (TL's) in the prior art must be designed to be a certain physical length in order to achieve a desired phase shift at a design frequency $f_o$ for the antenna (hereinafter, the term "antenna" shall refer to phased array antennas). This phase dependency on length can result in lines that must be "meandered" in order to maintain a small physical size footprint, as in the case of passive phased arrays.

In addition, this length dependency on phase results in increasing phase slopes over the design frequency band of the antenna, as a function of frequency, as the lines increase in physical length. The phase slope is the change in phase over the frequency band of interest. For conventional TL's, the slope of the phase response is a function of the physical length of the transmission line. As a result, as length of the conventional TL's increase, so does the phase slope. This can create a variety of different problems including an expanding footprint. Another problem can be a limitation in phase bandwidth that arises from TL's of different physical lengths having different phase slopes.

Figure 1:
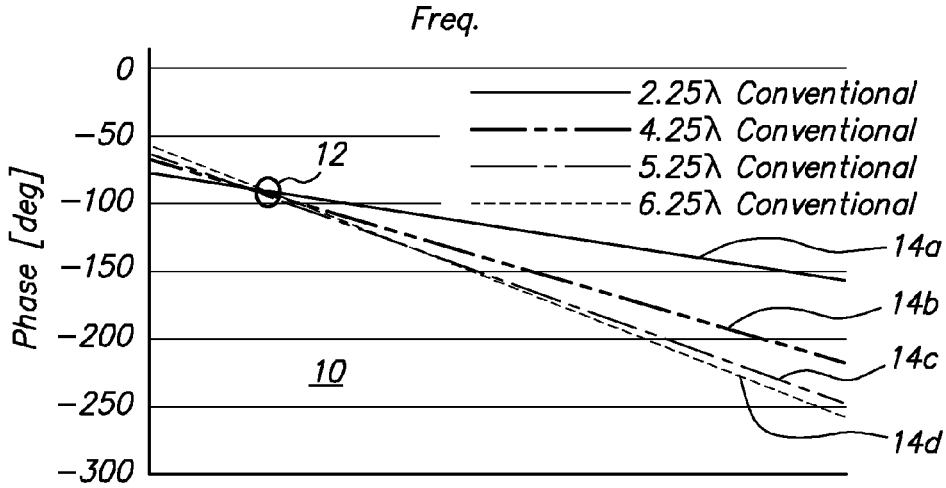
FIG. 1 (PRIOR ART)
FIG. 1 is a graph of phase versus frequency, which illustrates phase slopes for conventional right hand transmission lines (RH TL's) that are known in the prior art over a given frequency band of interest.

Referring now to FIG. 1, graph 10 of FIG. 1 is a graph of frequency versus phase over a design frequency band, which illustrates the phase response for different length conventional right-handed (RH) TL's. The lengths are expressed as multiples of the design wavelength λ. For conventional TL's, the slope of the phase response is a function of the physical length of the transmission line. As a result, as length of the conventional TL's increase, so does the phase slope. The following figure shows phase response for different length conventional right-handed TL's. The lengths are expressed as multiples of the guided wavelength λ. As can be seen, the different length TL's all have an equal phase of −90° at the design frequency, $f_0$, but each with different phase slopes.

FIG. 1 is illustrative of this phenomena. As shown in FIG. 1, the different length RH TL's all have an equal phase of −90° at the design frequency $f_o$ (point 12 in FIG. 1), but each RH TL has different phase slopes. Lines 14*a-d* in FIG. 1 illustrate the phase slope for RH TL's having a physical length of 2.25λ, 4.25λ 5.25λ and 6.25λ, respectively. FIG. 1 illustrates that when conventional RH TL's are used in the feed network of the array for the antenna, the RH TL's of different lengths exhibit different phase slope behavior, which can lead to a variety of performance issues. At the design frequency, $f_o$, 12, all of the TL's 14 have the same phase while outside of $f_o$ each of the TL's begin to exhibit increasingly different phase values. However, the radiation pattern of the array begins to diverge and scatter as a function frequency over the frequency bandwidth, since each antenna element in the array no longer maintains a uniform phase difference. This phenomena is often referred to in the prior art as 'beam squint'.

Figure 2A:
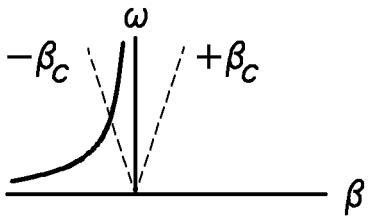
FIG. 2A (PRIOR ART)
FIGS. 2A-2C are generalized graphs of phase versus frequency for prior art left hand (LH), RH and composite right hand and left hand (CRLH) TL unit cells, which illustrate how the phase performance can be shifted.
Figure 2B:
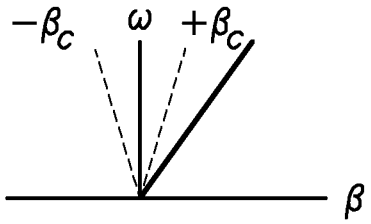
FIG. 2B (PRIOR ART)
Figure 2C:
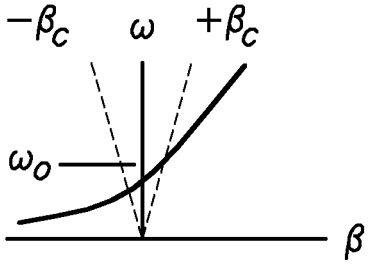
FIG. 2C (PRIOR ART)

To avoid beam squint, metamaterial transmission Lines (MTM TL's) can be used. MTM TL's can combine the negative phase (or phase delay) of conventional, right-handed RH TL's, with the positive phase (phase advance) exhibited by left-handed (LH) transmission lines. These Composite Right/Left Hand (CRLH) TL's can achieve a negative phase velocity in the left-hand frequency band, and a positive phase velocity in the right-hand frequency band. FIGS. 2A-2C illustrate the positive phase (+20°), zero-degree phase (0°) and negative phase (−20°) phase response at the design frequency $f_o$ for LH, RH and CRLH TL's, respectively. FIGS. 2A-2C imply that for MTM TL's, arbitrary phase-shifts can be achieved, zero and non-zero, both positive and negative phase across the length of the transmission line independent of their physical lengths. Currently, MTM-TL's in the prior art can be designed to have any phase, for any length.

Figure 3:
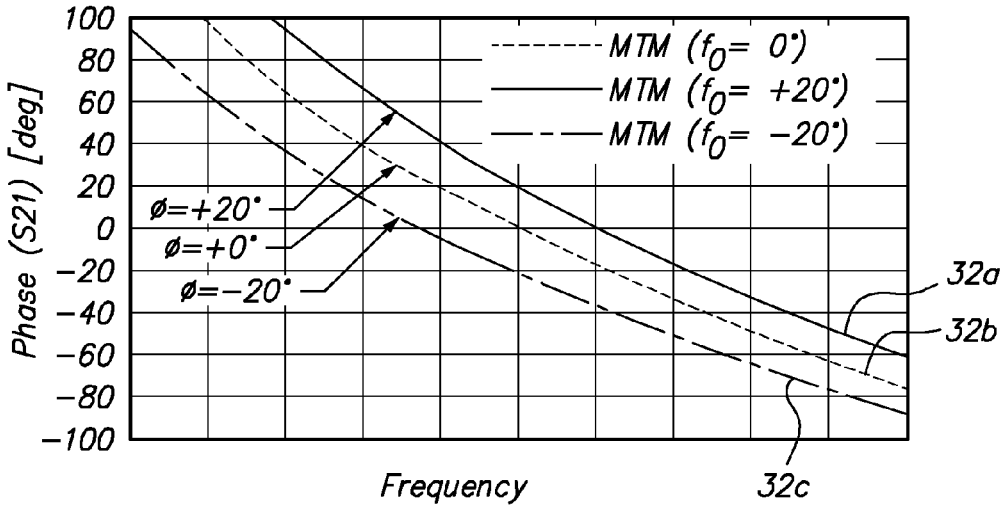
FIG. 3 (PRIOR ART)
FIG. 3 is a graph of phase versus frequency, which illustrates phase slopes for MTM TL's that are known in the prior art over a given frequency band of interest.

FIG. 3 is graph of phase versus frequency for the above-mentioned MTM TL's of the prior art that are referred to in FIGS. 2A-2C. In FIG. 3, note the different phase slopes 32*a*, 32*b* and 32*c* (which correspond to FIGS. 2A, 2B, and 2C, respectively) for the different MTM lines are not parallel. This can be because MTM-TL's in the prior art have been designed by using a series connection of homogeneous CRLH unit cells. Thus, while MTM-TL's which have been designed for the desired phase shifts can be used to avoid the meandering issue, the MTM-TL's of the prior art can be limited in their ability to be designed for a desired phase slope response over the entire frequency band of interest (i.e., beam squint can still be a problem for these MTM-TL's).

The invention disclosed herein presents a family of equal phase and parallel phase slope MTM TL's composed of inhomogeneous CRLH unit cells of the same physical length, combined in such a manner to allow for the construction of arbitrary length TL's with equal phase at $f_o$, and parallel phase slopes across the frequency band. The equal phase slope MTM TL's disclosed in this patent can be thought of as a hybrid TL consisting of a combination of conventional RH-TL's section with a series dissimilar CRLH metamaterial unit cells. The CRLH metamaterial unit cells all have positive phase shifts at $f_o$, which can act to offset or cancel a certain amount of the negative phase shift of the conventional RH-TL sections. This series combination of CRLH unit cells with the conventional RH-TL sections allows the user to engineer TL's that a the desired phase at $f_o$, and also have a uniform phase slope across the frequency band of interest (the design frequency band).

The prevent invention according to several embodiments can be thought of as a family of TL's which can include RH and CRLH building blocks, which result in a TL with a smaller physical footprint, with a broadband phase performance, that can replace conventional delay lines used in various RF and antenna applications. Each of the CRLH unit cells can have of the same physical length, but are designed to have various amount of positive phase shift. These lines can be designed with different metamaterial unit cell architectures to operate across various frequencies bands including UHF, X-band and Ku-band frequencies.

The Equal Phase/Phase Slope MTM-TL's of the present invention can be a series combination of inhomogeneous CRLH metamaterial unit cells each with some specified phase/phase slope, and conventional transmission line sections of a specified length/phase/phase slope; to which the RF ports are connected at each end. Each of the unique CRLH unit cells have a different phase and phase slope response. By connecting in series, the various combinations of different CRLH unit cells with the conventional RH-TL sections, of various lengths, allows for the design of equal phase/phase slope TL's of various physical lengths.

Figure 4:
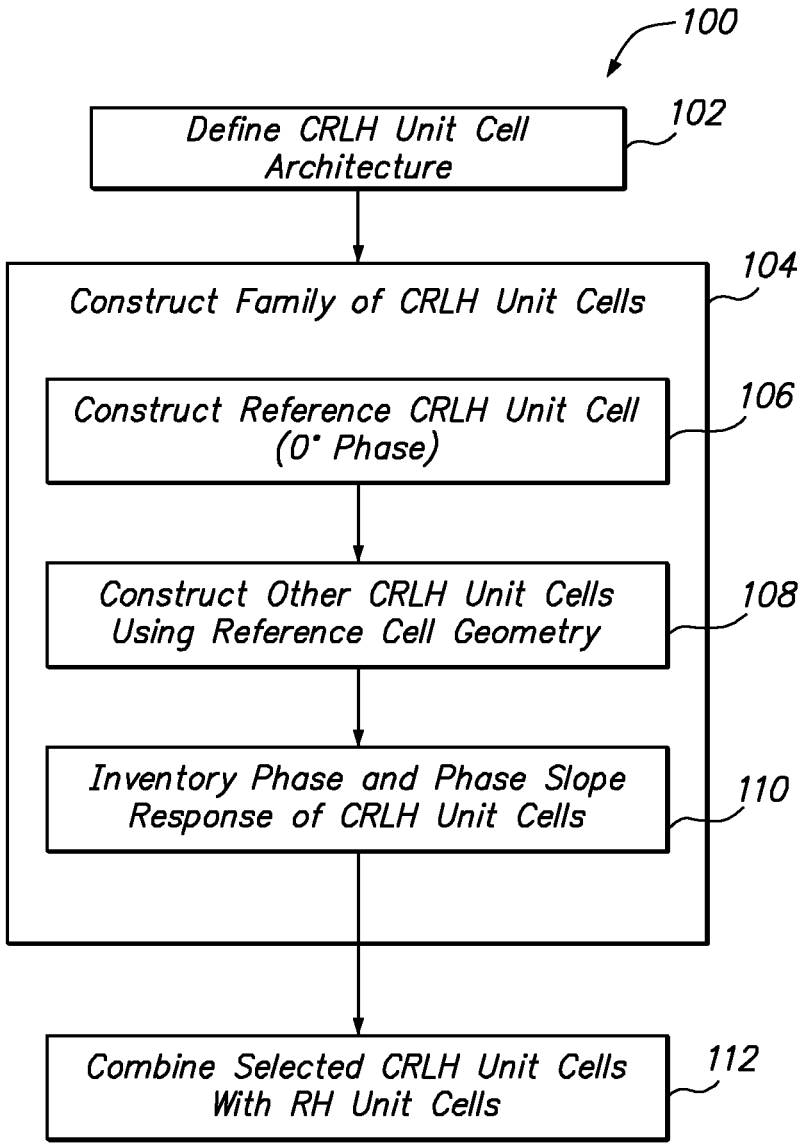
FIG. 4 is a block diagram of methods that can be taken to accomplish the steps of the methods according to several embodiments.

Referring now to FIG. 4, a block diagram that can be used to practice the design methodology for the equal phase/equal phase slope MTM-TL's of the present invention according to several embodiments is shown and is designated by reference character 100. As shown, the method 100 can include the initial block 102 of defining a CRLH unit architecture TL CRLH unit cells. To do this, the design frequency $f_0$ and frequency band for the phased array antenna should be known. These parameters are the first consideration in the material stack-up (or material layers), which the MTM-TL will be designed to.

Figure 5:
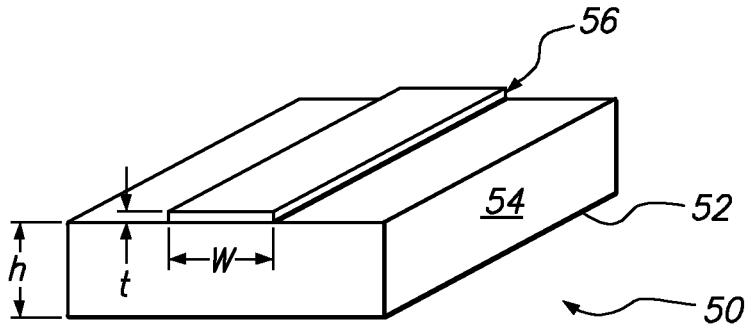
FIG. 5 is a side elevational view of a microstrip unit cell architecture for several embodiments of the unit cells in FIG. 4.
Figure 6:
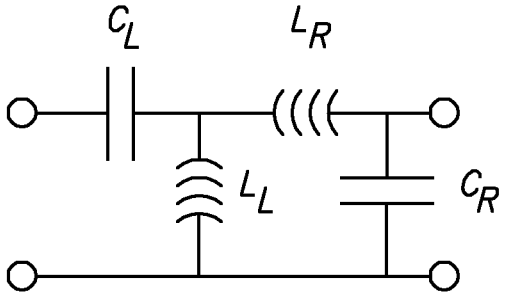
FIG. 6 is an electrical circuit representation of the microstrip unit cell architecture of FIG. 5.

These CRLH unit cells can be constructed from lumped components for frequencies below 1 GHz, but for higher frequencies they can be engineered into the substrate of the RF circuit board used. This is most commonly done using microstrip circuit technology. FIGS. 5 and 6 are illustrative of such technology. FIG. 5 shows a typical example of the material stack-up for the construction of the CRLH unit cell 50. Unit cell 50 can further include a conductive ground phase layer 52, a dielectric substrate 54 that is superimposed over layer 52 and a conductive inductor stub 56 that is superimposed of substrate 54. The phase response of the CRLH unit cell can be engineered by controlling the various series/shunt, capacitive/inductive components in each unit cell. The equivalent circuit model for the CRLH unit cell is shown in FIG. 6. This circuit model consists of Left handed and Right handed capacitor elements and inductor elements, ($C_L$, $L_L$) and ($C_R$, $L_R$), respectively. The left/right handed circuit elements contribute to the positive and negative phase shift across the unit cell respectively.

Figure 7A:
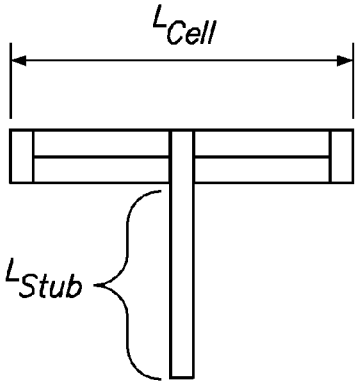
FIGS. 7A-7B are respective top plan and side elevational views of the inductor stub portion of the unit cells of FIG. 5.
Figure 7B:
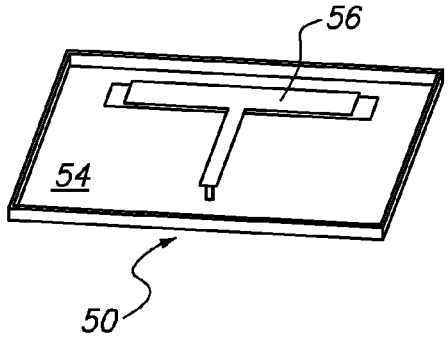

There are several different architectures types that can be used to engineer these electrical components into the chosen substrate technology. The architecture shown in FIG. 5. FIGS. 7A and 7B illustrate the structure Metal-Insulator-Metal (MiM)/Inductor Stub type architecture from FIG. 5 more clearly. The left handed circuit components ($C_L$, $L_L$) referred to in FIG. 6 can be engineered into the microstrip structure through the construction of the MiM capacitor and an inductor stub. The right-handed components ($C_R$, $L_R$) arise from the inherent parasitic present in the microstrip structure. A careful balancing of the positive phase shift associated with $C_L$, $L_L$ and the negative phase shift with $C_R$, $L_R$ is required for the design of the desired phase shift at $f_o$.

Once the CRLH architecture of a unit cell has been determined, and referring back to FIG. 4, the next step for the methods of several embodiments can be to construct a family of the various CRLH metamaterial unit cells that are of the same physical length, given the established material stack-up, as indicated by block 104 in FIG. 4. First, a baseline CRLH unit cell having a phase shift of 0° can be established, as shown by step 106 in FIG. 4. The unit cell is based on the composite right-handed and left-handed (CRLH) MTM TL circuit model shown in FIG. 5. As previously mentioned, inductor stub is used for $L_L$ and a MiM capacitor is used for $C_L$. The right-handed components $L_R$ and $C_R$ come from the inherent microstrip parasitics. FIGS. 7A and 7B illustrate an example design of a 0° CRLH unit cell for Ku-band frequencies. This baseline CRLH unit cell was designed on two layers of Kapton E dielectric ($\epsilon_r$=3.1, tan δ=0.002), each 15 mils in thickness. The overall length $L_{Cell}$ can be roughly $\lambda_g/4$ at the design frequency of $f_o$ in the Ku band.

Figure 8A:
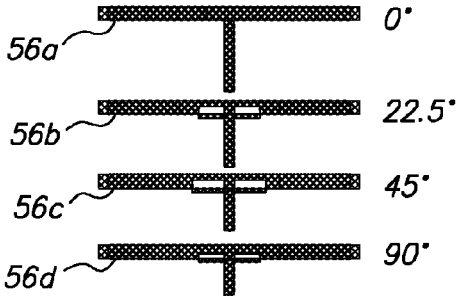
FIGS. 8A-8*b* are respective top plan and elevational views of a family of unit cells of FIG. 5, but with the inductor stub length varied, in order to yield a varied phase response for each unit cell.
Figure 8B:
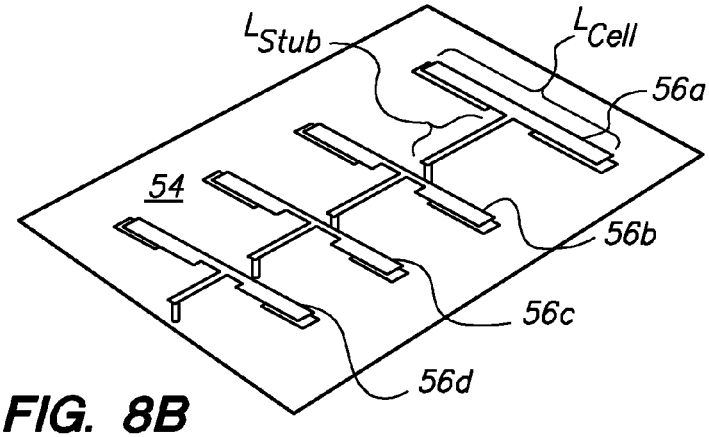

After the baseline 0° unit cell has been designed, and as indicated by step 108 in FIG. 4, the other unit cells with the various phase shifts are achieved by modifying the unit cell geometry can be generated, while keeping the cell length $L_{Cell}$ fixed. This can be achieved through various means. One method to tune the phase shift is through a variation of the inductor stub length $L_{Stub}$, and the length of the lower layer MiM capacitor plate. FIGS. 8A and 8B display several different CRLH unit cells that are of the same physical length, but each with various phase values because the inductor stub length $L_{Stub}$ for stubs 56*a*-56*d* is different, and because the amount of overlap between upper and lower conductive layers of the MiM capacitor is varied.

Figure 9:
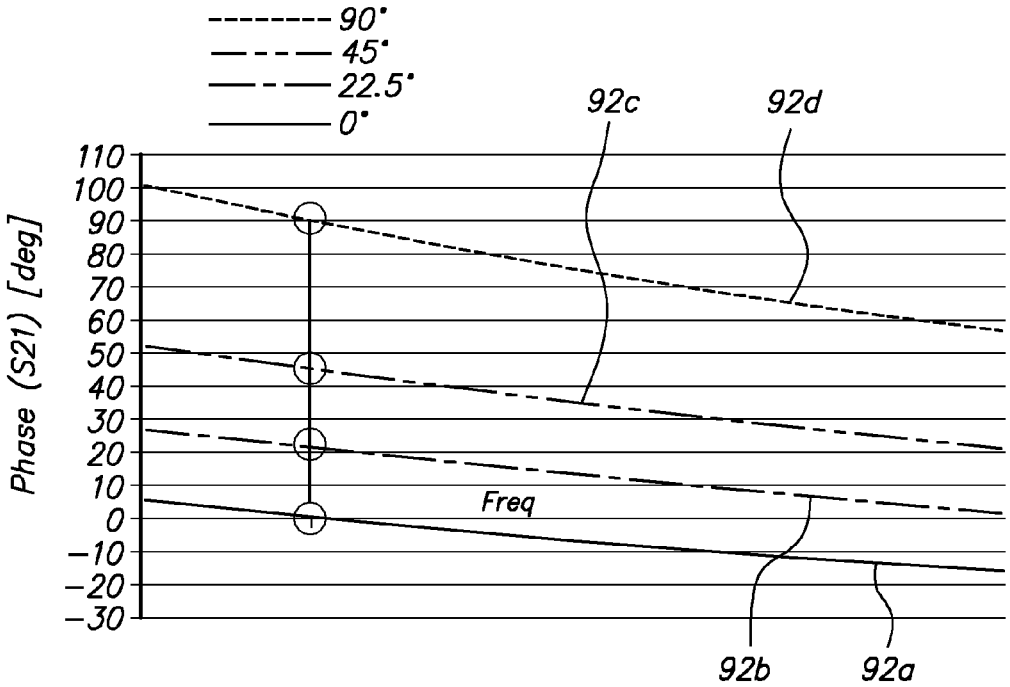
FIG. 9 is a graph of the phase response for each of the unit cells from FIG. 8; and, FIG. 10 is a graph of a plurality of MTM TL's which has been establish in accordance with the method of the present invention according to several embodiments, which illustrate the uniform phase and phase slope response for each member in the family.

FIGS. 8A and 8B illustrate a family of different phased CRLH Unit Cells. The simulated phase response of these different unit cells (having inductor stubs 56*a*-56*d*) is indicated by lines 92*a*-92*d* in FIG. 9. The phase for each unit cell was constructed in multiples of +90° (0°, +22.5°, +45°, +90°) of phase shift at a design frequency $f_o$ in the Ku band. For a finer phase resolution, additional phased unit cells can be designed. Note the different phase slopes for each unit cell. In addition to achieving a specific phase response, it is equally important is to ensure that the unit cells are well-matched to the impedance of the microstrip TL. A significant part of the design requires several iterations in the unit cell geometries to ensure that each unit cell are well matched, and achieve the desired phase shift in the frequency band of interest. A simultaneous comparison of the simulated voltage parameters S21 insertion (magnitude, in dB), both in magnitude and phase.

After designing this family of CRLH unit cells with the acceptable phase and impedance response, the next step in the design is to inventory the different simulated phase/phase slope responses for each of the different unit cells in the family. This is depicted by step 110 in FIG. 4. This family of unit cells can be combined with conventional right-handed TL sections (step 112 in FIG. 4), which can allows for the possibility of engineering both positive and negative phase shifts. In addition, having this mixture of both positive and negative phases each with different phase slopes, allows for more flexibility in the design possibilities for the equal phase/phase slope MTM-TL's. The accomplishment of step 110 can result in in a table such as Table I below, which can summarize the properties different CRLH unit cells resulting from step 108, with the conventional RH-TL sections, along with their associated phase and phase slopes.

TABLE I

UNIT CELL CHART.

| | Design Parameters | | |
|---|---|---|---|
| Type | Physical Length | Phase | Phase Slope ($\Delta\phi/\Delta f$) |
| CRLH (unit cell) | ~$\lambda_g/4$ | +90° | −27.30°/GHz |
| CRLH | ~$\lambda_g/4$ | +45° | −18.94°/GHz |
| CRLH | ~$\lambda_g/4$ | +22.5° | −15.39°/GHz |
| CRLH | ~$\lambda_g/4$ | 0° | −12.66°/GHz |
| Conv. RH-TL | $\lambda_g/8$ | −45° | −2.73°/GHz |
| Conv. RH-TL | $\lambda_g/4$ | −90° | −5.44°/GHz |
| Conv. RH-TL | 3 $\lambda_g$ | 3 * (−360°) = 0° | −64.95°/GHz |
| Conv. RH-TL | 4 $\lambda_g$ | 4 * (−360°) = 0° | −86.56°/GHz |
| Conv. RH-TL | 6.25 $\lambda_g$ | 6 * (−360°) − 90° = −90° | −135.40°/GHz |

As mentioned above, the final step 112 in FIG. 4 for the methods according to several embodiments can be to construct the equal phase/phase slope MTM-TL's by combining various series combinations of CRLH unit cells from this family, with conventional RH-TL sections of various lengths. To demonstrate the novelty of these MTM-TL's, a conventional TL of some arbitrary length, (6.25$\lambda_g$), was used here for comparison. The objective here was to both match the phase and phase slope of this conventional TL, through the appropriate combinations of CRLH unit cells (UCs), and conventional RH-TL sections.

To do this, it should be appreciate that when two different CRLH unit cells are connected together, both the phase and the phase slope add linearly, in addition to the phase/phase slope of the conventional RH-TL sections. Based on this, one can construct various MTM-TL's of various physical lengths, all with the same phase/phase slope at $f_o$. For our example, it is desired to contract a conventional RH TL with a physical length of 6.25$\lambda_g$, a phase of −90°, and a phase slope of −135.40°/GHz. To construct this TL. an MTM-TL of length 2.75$\lambda_g$ can be constructed from ten 0° CRLH unit cells and a one conventional RH-TL section of length 0.25$\lambda_g$, for a total phase of 10*(0°)−90°=−90° and total phase slope of 10*(−12.66)−5.44=−132.04 deg/GHz. Table II lists the various MTM-TL's transmission lines constructed to achieve the same phase (±90°) and a phase slope (−130°/GHz) at $f_o$ in the Ku band.

TABLE II

UNIT CELL CHART

| Physical Length | 0° | 22.5° | 45° | 90° | Conv. | Total Phase at $f_0$ | Total Phase Slope: $\Delta\phi/\Delta f$ |
|---|---|---|---|---|---|---|---|
| 2.75 $\lambda_g$ | 10 UCs | | | | .25 $\lambda_g$ | −90° cal. −95.2° sim. | −132.0° cal. −130.4° sim. |
| 4 $\lambda_g$ | 3 UCs | | | 1 UCs | 3 $\lambda_g$ | 90° cal. 96.76° sim. | −130.23° cal. −131.27° sim.. |
| 4.75 $\lambda_g$ | 2 UCs | | | 1 UCs | 4.0 $\lambda_g$ | 90° cal. 94.7° sim | −139.18° cal. −140.71° sim. |

Form Table II above, it can be seen that by using the methods of the present invention according to several embodiments, to achieve a design phase of −90° at $f_0$ and a phase slope of −130°/GHz (which was substantially similar to the desired design phase of −90°, and a phase slope of −135.40°/GHz), 10 CRLH unit cells (UC's) with 0° phase can be used in combination with one 0.25$\lambda_g$ RH TL. The resulting combination has substantially that same total phase at $f_0$ and phase slope, but the physical length of the TL is much shorter (2.75$\lambda_g$) that the physical length of the conventional RH TL (6.75$\lambda_g$).

Figure 10:
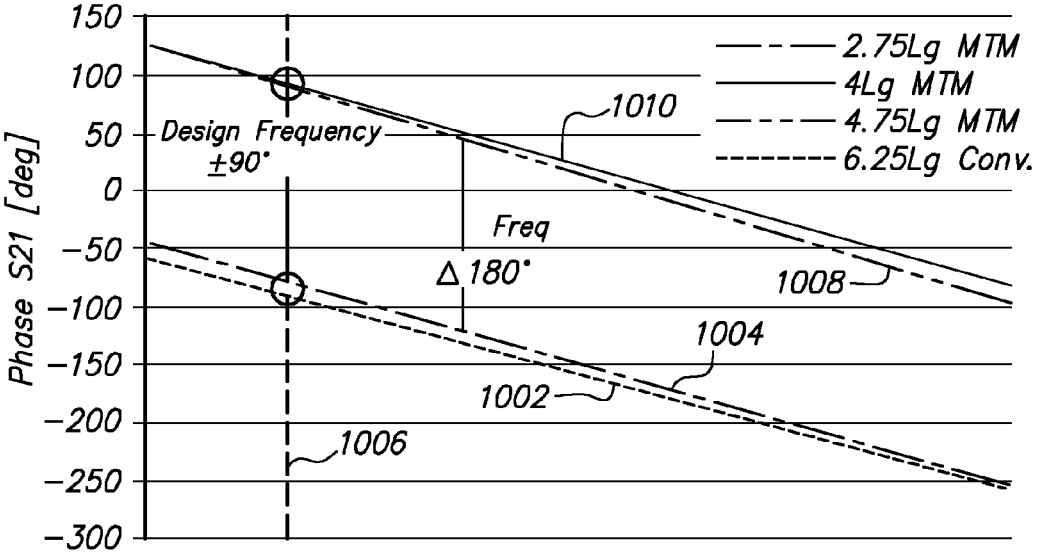

FIG. 10 illustrates the simulated phase slopes for each of the constructed MTM-TL's. Line 1002 is the graph for the design 6.75$\lambda_g$ −90° at $f_0$' while line 1004 is the graph for the phase response for the 2.75$\lambda_g$ TL, which was assembled according to the method of the present invention. Note that lines 1002 and 1004 have substantially the same phase a $f_0$ (character 1006) and a phase slope of −130°/GHz. Stated differently, lines 1002 and 1004 have the same phase and same phase slope as the 6.25$\lambda_g$ conventional TL, as intended. Contrast this phase behavior with that of conventional TL's of FIG. 1. Recall from FIG. 1 that the un-wrapped phase is shown for a family of conventional TL's of lengths 2.25$\lambda_g$, 4.25$\lambda_g$, 5.25$\lambda_g$ and 6.25$\lambda_g$, all representing the equivalent of −90° at $f_o$. One can see here the limitation in phase bandwidth of these TL's as their lengths increase. By cross-referencing FIGS. 1 and 10, it can be seen that the methods of the present invention can result in different size TL's with uniform phase at $f_0$ and with substantially uniform phase sloped for the frequency band of interest. This allows for much greater flexibility in the design of the antenna.

Is should be appreciate that there is no limitation on the frequency band of operation for the design of these equal phase/phase slope MTM-TL's. The design methodology presented here is equally valid within any frequency band, with the only limitations are on the fabrication technologies required for the construction of the CRLH unit cell. Since the substrate parasitics are explicitly accounted for in the phase response of the CRLH unit cells, the use of high fidelity electromagnetic modeling tools is sufficient for their design, as long as the properties of used materials are known accurately within the design frequency band of operation.

The advantage of having equal phase sloped TL's of arbitrary lengths, is that it is often desired in many applications to have various RF components phased in such a manner that a uniform phase difference is maintained over a frequency band. Table II and FIG. 10 also demonstrate these embodiments. The MTM-TL's demonstrated here have this capability, as the equal phase slopes ensure a uniform phase difference. For example, see the uniform phase difference, (Δ180°), shown in FIG. 10 between the $2.75\lambda_g$ and $6.75\lambda_g$ MTM-TL's (lines 1002 and 1004) and between the $4.0\lambda_g$ and $4.75\lambda_g$ MTM-TL's (lines 1008 and 1010 in FIG. 10).

There are several alternative methods to the proposed version of the invention disclosure. Specifically, the composite metamaterial unit cells used in the design can be equal in stub length but with different phase and phase slopes. Also, the unit cells can be designed un-equal in length with different phase and phased slopes. Also, the metamaterial unit cells can be designed unequal in length but with similar phase and phase slopes. This unit cell diversity can enable a distribution of sizes, phases and phase slope choices from which the Equal Phased Slope MTM TL's can be designed. This in turn enables a trade-space in which the design specs of the delay line can be achieved such as a design in order to the route the delay line within the desired overall footprint.

Equal phased/phase sloped Phased MTM TL's can be designed across any frequency band of interest. The design methodology holds. The methodology can be used to design devices at UHF, L S, C and X-band and most notably at KU-band. The challenge at each frequency band becomes identifying the baseline 0° unit cell that sets the template for the design. This requires identification of the appropriate material stack-up, the inductor and capacitor used for the left-handed components, the inherent right-handed parasitics and the balancing of these components to yield a stable CRLH unit cell design.

Also, it should be appreciated that the present disclosure focused on a specific CRLH unit cell architecture consisting of a MiM Capacitor and Inductor Stub. There are several different component types that can be used instead including interdigital capacitors, lumped components, and similar types of components. The choice of the architecture depends only upon the frequency of operation, material stack-up and the eventual application of the delay line to the RF circuit. A strict requirement on the components used within the CRLH architecture specified by these inductors and capacitors is to achieve the left-handed and right-handed behavior necessary for the CRLH unit cell to work properly. The present disclosure presents designs of Equal Phased Slope MTM TL's that are physically straight. In general, when applied, these delay lines may also be meandered around to fit a desired footprint. Also, each unit cell, and conventional transmission line may also be meandered around within the line to provide some flexibility in the routing of the line. Again, in order to work properly, the Equal Phase Slope MTM TL's must be always be tuned so that they maintain their desired performance.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method for establishing a plurality of transmission lines (TL's) for a phased array antenna having a design frequency $f_0$ and a design frequency band, said TL's each having an overall phase and an overall phase slope over said frequency band, said method comprising the steps of:

A) defining a Composite Right/Left Hand (CRLH) unit cell, said CRLH unit cell having a CRLH architecture;

B) constructing a family of said CRLH unit cells using said CRLH architecture, said CRLH unit cells each having a physical length, a cell phase and a cell phase slope, said constructing step being accomplished so that said CRLH unit cells have substantially the same said physical length, but different said cell phases and different said cell phase slopes; and, C) for each said TL of said plurality, combining at least one of said family from said step B) with at least one Right Hand (RH) unit cell, so that each said TL in said plurality has substantially the same said overall phase and substantially the same said overall phase slope over said frequency band.

2. The method of claim 1 wherein said design frequency is above 1 GHz and said architecture is microstrip architecture.

3. The method of claim 2, wherein said microstrip architecture further comprises a dielectric insulator positioned between a metal ground phase layer and a metal inductor stub.

4. The method of claim 3, wherein said step B) further comprises the steps of:

B1) constructing a first said CRLH unit cell having a phase of zero degrees, said first CRLH unit cell having a cell geometry comprising a first cell length and a first stub length; and, B2) constructing other of said CRLH unit cells; and said other CRLH unit cells each having a cell length that is substantially equal to said first cell length, each said other CRLH unit cells further having a stub length that is different from said first stub length.

5. The method of claim 1 wherein each said RH unit cell has a physical length, wherein is TL from said plurality has an overall physical length, and wherein said step C) is accomplished so that each said TL from said plurality has a different said overall physical length.

6. A plurality of metamaterial transmission lines (TL's) for a phased array antenna, said phased array antenna having a design frequency $f_0$ and a design frequency band, each said TL having an overall phase and an overall phase slope across said frequency band, each said TL comprising:

at least one right hand (RH) unit cell;

at least two inhomogenous composite right/left hand (CRLH) unit cells; and, for each said TL, said at least one RH unit cell and said at least two CRLH unit cells being combined so that each said TL in said plurality has a substantially uniform said overall phase and said overall phase slope.

7. The plurality of claim 6 wherein said CRLH cells have a cell architecture, said design frequency $f_0$ is above 1 GHz, and said cell architecture is microstrip architecture.

8. The plurality of claim 7, wherein said microstrip architecture further comprises a dielectric insulator positioned between a metal ground phase layer and a metal inductor stub.

9. The plurality of claim 6 wherein each said CRLH TL has a geometry defined by a physical length and a stub length, and wherein each said stub lengths are inhomogenous.

* * * * *